US005337442A

United States Patent [19]

Stewart

[11] Patent Number: 5,337,442

[45] Date of Patent: Aug. 16, 1994

[54] SCRAPER APPARATUS

[76] Inventor: Gordon D. Stewart, 210 Vinton Box 232, Henning, Ill. 61848

[21] Appl. No.: 982,608

[22] Filed: Nov. 27, 1992

[51] Int. Cl.[5] ..... A47L 13/02

[52] U.S. Cl. ..... 15/236.01; 30/169; 30/320; 30/337

[58] Field of Search ..... 15/236.01, 236.02, 236.05, 15/236.06, 236.08; 30/169, 172, 329, 337, 320, 138; 7/158, 169, 170

[56] References Cited

U.S. PATENT DOCUMENTS

| | | | |
|---|---|---|---|
| 187,811 | 2/1877 | Carter | 15/236.06 |
| 656,468 | 8/1900 | Mullin | 30/172 |
| 884,030 | 4/1908 | Morton | 30/138 |
| 1,627,689 | 5/1927 | Culver | 30/138 |
| 1,898,422 | 2/1933 | Champlin | 30/138 |
| 2,546,577 | 3/1951 | Young | 15/236.08 |
| 2,983,943 | 5/1961 | Fendler | 30/172 |
| 3,092,411 | 6/1963 | Hardy | 30/169 |
| 4,011,657 | 3/1977 | Vance | 30/337 |
| 4,574,417 | 3/1986 | Magnasco | 30/172 |
| 4,704,795 | 11/1987 | Primich | 15/236.01 |

FOREIGN PATENT DOCUMENTS

| | | | |
|---|---|---|---|
| 287684 | 10/1915 | Fed. Rep. of Germany | 30/172 |
| 15149 | 11/1905 | Norway | 30/172 |
| 163796 | 9/1933 | Switzerland | 30/172 |

*Primary Examiner*—Timothy F. Simone

*Assistant Examiner*—Randall E. Chin

[57] ABSTRACT

A new and improved hand-held scraper apparatus is disclosed for scraping a surface at a plurality of predetermined scraping angles. The apparatus includes a blade support, and the apparatus is used by an operator for scraping a surface with a push-pull scraping motion parallel to the longitudinal axis of the blade support. More specifically, the apparatus includes a rigid handle, a rigid blade support connected to the handle, and a plurality of non-adjustable, blade-receiving slots located in the blade support and arranged at predetermined increments along the longitudinal axis. Each of the blade-receiving slots is oriented at a respective predetermined slant angle with respect to the longitudinal axis. The slant angles are in a range from ninety degrees to zero degrees. A blade is inserted into a respective blade-receiving slot, and, in use, the blade forms a respective scraping angle with the surface that is scraped. The respective scraping angle is supplementary to the respective slant angle. The handle has a longitudinal axis which is parallel to the blade support longitudinal axis, and the handle and the blade support are a one-piece structure. The respective blade-receiving slots include guide pins for guiding the blade into the respective blade-receiving slots. The blade also includes guide slots that are complementary to the guide pins. The blade-receiving slots also include gripping devices, such as spring-loaded rollers, to grip complementary structures, such as notches, on the blade.

3 Claims, 3 Drawing Sheets

SCRAPER APPARATUS

BACKGROUND OF THE INVENTION

1. Field of the Invention

The present invention relates generally to devices for scraping a material off of a substrate, and particularly relates to hand-held scrapers especially adapted to scrape off paint, varnish, rust, and other deposits from surfaces.

2. Description of the Prior Art

Hand-held scrapers are well known in the art. For example, U.S. Pat. No. 3,670,414 of Stecker discloses a paint scraper which employs a resilient sheet metal strip bent back over itself to form a handle for carrying a blade. The alignment of an operator's shoulder, arm, wrist, and hand would vary as the scraping angle between the blade and the surface being scraped would vary. With such an arrangement, undue stress my be experienced by the operator's wrist resulting in premature wrist fatigue.

Each of U.S. Pat. No. Des. 274,148 of Levy, U.S. Pat. No. 4,768,254 of Bell, U.S. Pat. No. Des. 305,818 of Chen, U.S. Pat. No. 4,984,324 of Farris, and U.S. Pat. No. 5,009,009 of Stinson discloses a paint scraper having a blade with a single fixed slant angle with respect to a rigid handle. To scrape a surface at different scraping angles, the alignment of an operator's shoulder, arm, wrist, and hand would vary as the scraping angle between the blade and the surface being scraped would vary. Once again, such an arrangement may result in premature wrist fatigue.

U.S. Pat. No. 4,559,661 of Tsals et al discloses a powered paint scraper that has a blade having a single slant angle with respect to a handle. Although the blade is powered to move longitudinally with respect to the longitudinal axis of the handle, to scrape surface at different scraping angles, the alignment of an operator's shoulder, arm, wrist, and hand would vary as the scraping angle between the blade and the surface being scraped would vary, and wrist fatigue may prematurely result.

Thus, while the foregoing body of prior art indicates it to be well known to use hand-held scrapers, the provision of a simple and cost effective device is not contemplated in the prior art that permits the alignment of an operator's shoulder, arm, wrist, and hand to remain constant as the scraping angle between the blade and the surface being scraped would vary. Moreover, the prior art does not disclose a hand-held scraper that permits the operator to carry out a consistent scraping action using the upper shoulder and upper arm muscles in straight push-pull actions, even though different scraping angles are employed. Furthermore, the prior art does not provide a scraper designed to reduce wrist fatigue. The foregoing disadvantages are overcome by the unique scraper apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, is a hand-held scraper apparatus for scraping a surface at a plurality of predetermined scraping angles. The apparatus includes a blade support, and the apparatus is used by an operator for scraping a surface with a push-pull scraping motion parallel to the longitudinal axis of the blade support. More specifically, the apparatus is comprised of rigid handle, a rigid blade support connected to the handle, and a plurality of non-adjustable, blade-receiving slots located in the blade support and arranged at predetermined increments along the longitudinal axis. Each of the blade-receiving slots is oriented at a respective predetermined slant angle with respect to the longitudinal axis. The slant angles are in a range from ninety degrees to zero degrees. A blade is inserted into a respective blade-receiving slot, and, in use, the blade forms a respective scraping angle with the surface that is scraped. The respective scraping angle is supplementary to the respective slant angle. The handle has a longitudinal axis which is parallel to the blade support longitudinal axis, and the handle and the blade support are a one-piece structure. The respective blade-receiving slots include guide pins for guiding the blade into the respective blade-receiving slots. The blade may also include guide slots that are complementary to the guide pins. The blade-receiving slots may also include gripping devices, such as spring-loaded rollers, to grip complementary structures, such as notches, on the blade. A receptacle may be located in the handle for retaining a file for sharpening a blade.

With the scraper apparatus of the invention, the operator can keep a substantially constant alignment of his shoulder, arm, wrist, and hand during different scraping operations even though different predetermined scraping angles are used between the blade and the surface being scraped. This benefit of the scraper apparatus of the invention removes a great deal of stress from the wrist and saves the wrist from experiencing undesirably rapid fatigue. This constancy of alignment of the shoulder, arm, wrist, and hand for different scraping angle operations permits the operator to carry out a consistent scraping action using the upper shoulder and upper arm muscles in straight push-pull actions, even though different scraping angles are employed.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved scraper apparatus which has all of the advantages of the prior art and none of the disadvantages.

It is another object of the present invention to provide a new and improved scraper apparatus which may be easily and efficiently manufactured and marketed.

It is a further object of the present invention to provide a new and improved scraper apparatus which is of durable and reliable construction.

An even further object of the present invention is to provide a new and improved scraper apparatus which is susceptible of a low cost of manufacture with regard to both materials and labor, and which accordingly is then susceptible of low prices of sale to the consuming public, thereby making such scraper apparatus available to the buying public.

Still yet a further object of the present invention is to provide a new and improved scraper apparatus that permits the alignment of an operator's shoulder, arm, wrist, and hand to remain constant as the scraping angle between the blade and the surface being scraped would vary.

Yet a further object of the present invention is to provide a new and improved scraper apparatus permits the operator to carry out a consistent scraping action using the upper shoulder and upper arm muscles in straight push-pull actions, even though different scraping angles are employed.

Still another object of the present invention is to provide a new and improved scraper apparatus that prevents the wrist from undergoing a disproportionally large degree of stress during scraping and prevents the wrist from experiencing undesirably rapid fatigue.

These together with still other objects of the invention, along with the various features of novelty which characterize the invention, are pointed out with particularity in the claims annexed to and form a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

With reference to the drawings, a new and improved scraper apparatus embodying the principles and concepts of the present invention will be described.

Figure 1:
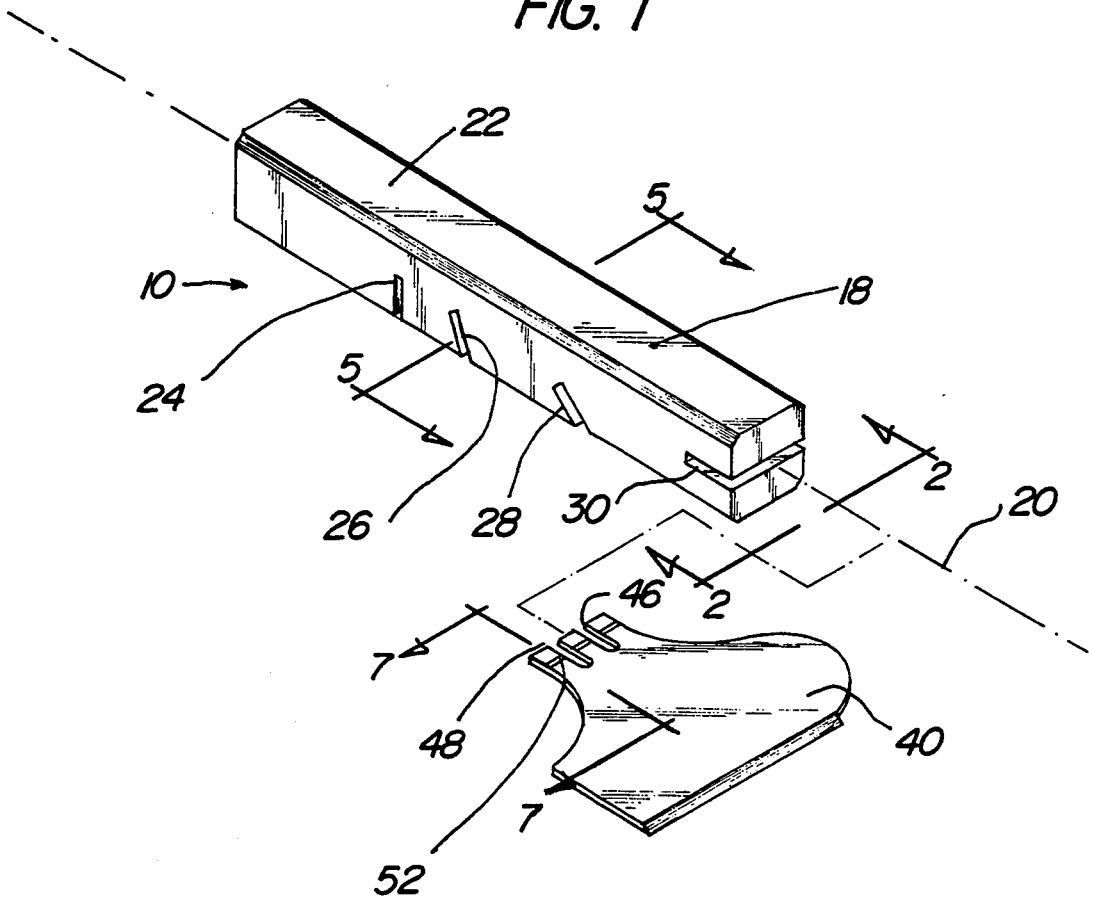
FIG. 1 is a perspective view, partially exploded, showing a first preferred embodiment of the scraper apparatus of the invention.
Figure 2:
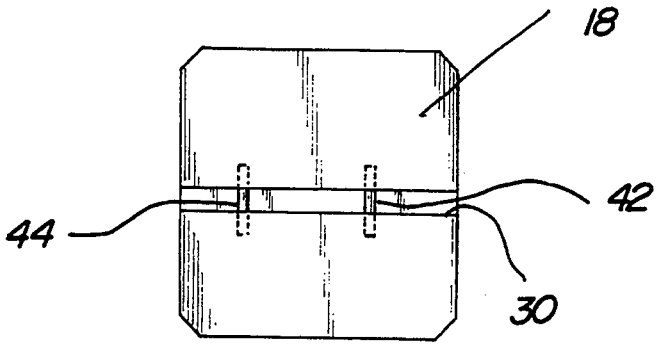
FIG. 2 is a cross-sectional view of the scraper apparatus of FIG. 1 viewed along line 2—2 of FIG. 1.
Figure 3:
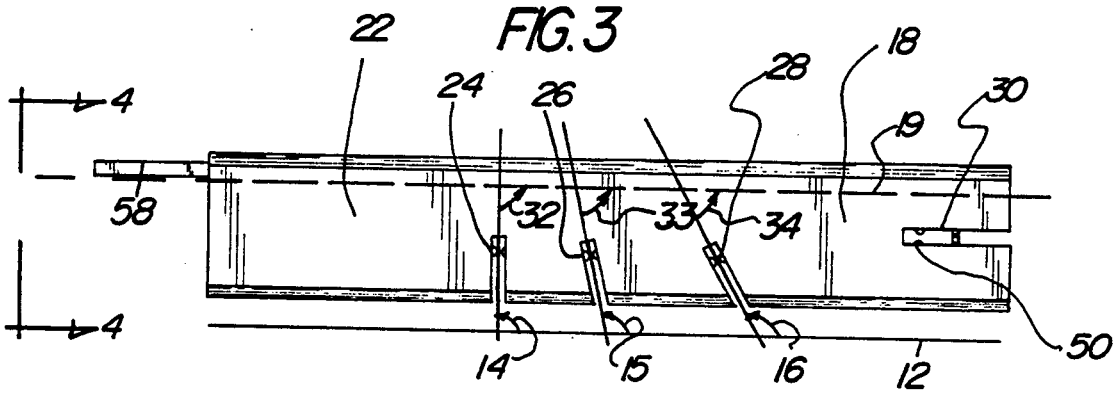
FIG. 3 is a side view of the scraper apparatus of FIG. 1.
Figure 4:
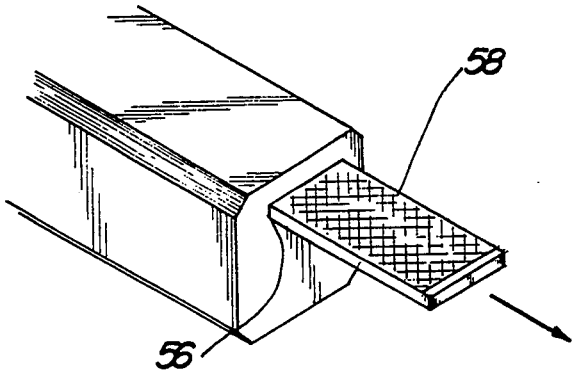
FIG. 4 is a partial perspective enlarged view of an end of the scraper apparatus shown in FIG. 3 taken along the line 4—4.

Turning initially to FIGS. 1–3, there is shown a preferred embodiment of the scraper apparatus of the invention generally designated by reference numeral 10. In its preferred form, hand-held scraper apparatus 10 is disclosed for scraping a surface 12 (see FIG. 3) at a plurality of predetermined scraping angles 14, 15, and 16. The apparatus 10 includes a blade support 18, and the apparatus 10 is used by an operator for scraping the surface 12 with a push-pull scraping motion parallel to line 19 which is parallel to the longitudinal axis 20 of the blade support 18. More specifically, the apparatus 10 is comprised of a rigid handle 22, the rigid blade support 18 connected to the handle 22, and a plurality of non-adjustable, predetermined blade-receiving slots 24, 26, 28, and 30 located in the blade support 18 and arranged at predetermined increments along the longitudinal axis 20.

Each of the blade-receiving slots 24, 26, 28, and 30 is oriented at a respective predetermined slant angle 32, 33, and 34 and slant angle of zero degrees with respect to the line 19 parallel to the longitudinal axis 20. The blade-receiving slots 24, 26, 28, and 30 have slant angles that are in a range from ninety degrees to zero degrees. More specifically, the slant angle 32 is for blade-receiving slot 24. The slant angle 33 is for blade-receiving slot 26. The slant angle 34 is for blade-receiving slot 28. And, the blade-receiving slot 30 has a slant angle of zero degrees.

A blade 40 is inserted into a respective blade-receiving slot. As shown in FIG. 1, blade 40 is to be inserted into blade-receiving slot 30. In use, the blade 40 forms a respective scraping angle with the surface that is scraped. As shown in FIG. 3, the respective scraping angles 14, 15, and 16 are supplementary to the respective slant angles 32, 33, and 34. More specifically, in accordance with a well-known law of geometry, for two parallel lines intersected by a transversal, same-side interior angles are supplementary; that is the sum of the angles equals 180 degrees.

The handle 22 has its own longitudinal axis which is coincident with, and therefore parallel to, the blade support longitudinal axis 20. The handle 22 and the blade support 18 are shown to be a one-piece structure.

The respective blade-receiving slots include guide pins 42 and 44 as shown in FIG. 2. The guide pins 42 and 44 serve to guide the blade 40 into the respective blade-receiving slot 30 in FIG. 1. The blade 40 may also includes guide slots 46 and 48 that are complementary to the guide pins 42 and 44, respectively.

Figure 5:
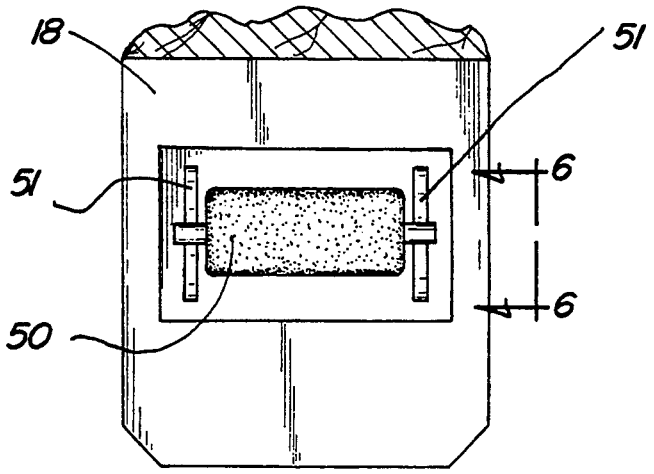
FIG. 5 is an enlarged cross-sectional view of the scraper apparatus shown in FIG. 1 taken along the line 5—5 in FIG. 1.
Figure 6:
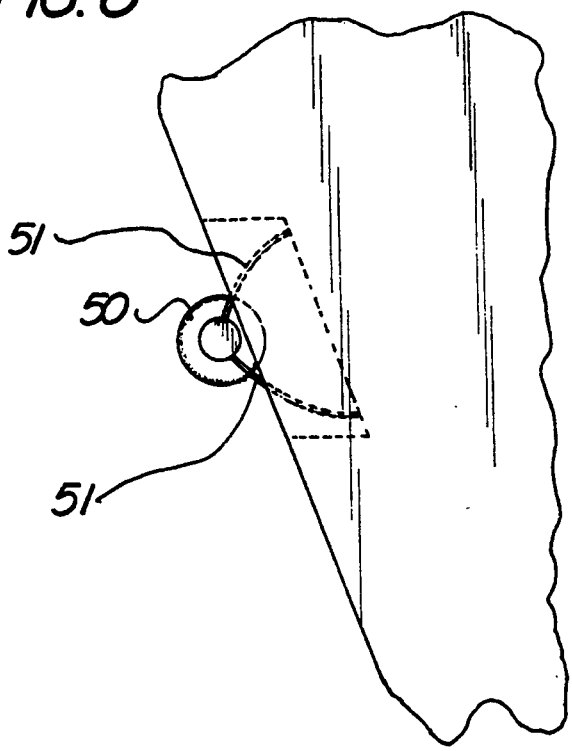
FIG. 6 is a partial, cross-sectional, phantom view of the scraper apparatus shown in FIG. 5 taken along the line 6—6 in FIG. 5.
Figure 7:
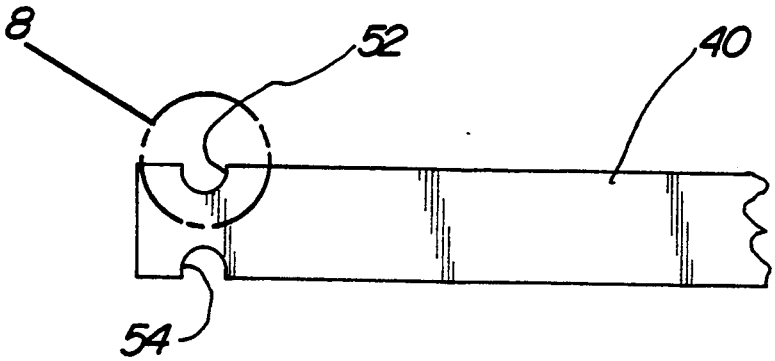
FIG. 7 is a partial, cross-sectional, enlarged view of a portion of the blade shown in FIG. 1 taken along the line 7—7 in FIG. 1.
Figure 8:
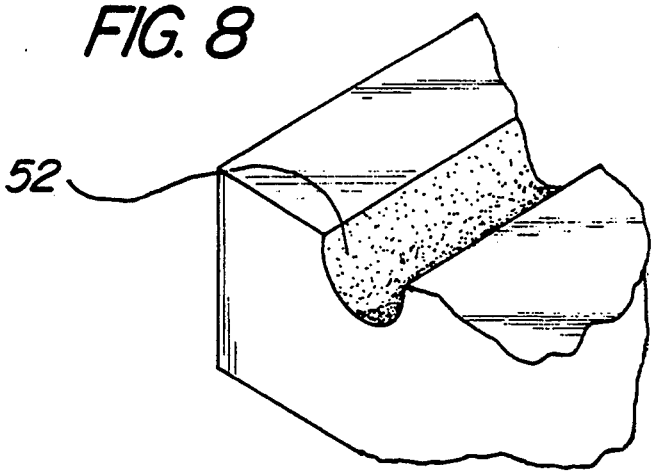
FIG. 8 is an enlarged perspective view of the portion of the blade in FIG. 7 that is encircled by the circle 8 in FIG. 7.

As shown most clearly in FIGS. 3, 5, and 6, the blade-receiving slots 24, 26, 28, and 30 also include gripping devices, such as spring-loaded rollers 50, to grip complementary structures, such as notches 52 and 54, on the blade 40. Leaf springs 51 support the rollers 50. The notches 52 and 54 and the surfaces of the rollers 50 can be roughened or rubberized to increase the coefficient of friction and thereby increase the gripping power between the rollers and the notches.

A slotted receptacle 56 is located in the handle 22 for retaining a file 58 for sharpening the blade 40. When the blade is to be sharpened, the file 58 is removed from the receptacle 56 and used to sharpen the blade 40. When the file 58 is not in use, it is stored in the receptacle 56 in the handle 22.

With the scraper apparatus of the invention, the operator can keep as a constant, the alignment of his shoulder, arm, wrist, and hand during different scraping operations even though different predetermined scraping angles 14, 15, and 16 are used between the blade and the surface 12 being scraped. This constancy of alignment of the shoulder, arm, wrist, and hand for different scraping angle operations permits the operator to carry out a consistent scraping action using the upper shoulder and upper arm muscles in straight push-pull actions, even though different scraping angles are employed. Moreover, the scraper apparatus of the invention reduces stress placed on the wrist of the operator, thereby helping to prevent premature wrist fatigue.

Preferably, the paint scraper has a total length of 9 inches, the handle has a length of 7 inches, and the blade is 3 inches wide. The blade is removable and fits interchangeably in the respective blade-receiving slots. The blade-receiving slots match and mate with either preformed or pinned guide elements.

The blade can be made from a heavy steel stock one-eighth thick and then sharpened. Also, the blade can be resharpened with a power grinder or a hand-held file. The handle can be made from wood or plastic.

Among other uses, the scraper apparatus of the invention can be used for scraping paint, varnish, rust, deposits on automobile engines, deposits on tools such as shovels and plows after garden work, and deposits of old mortar and mud from bricks.

It is apparent from the above that the present invention accomplishes all of the objects set forth by providing a new and improved scraper apparatus that is low in cost, relatively simple in design and operation, and which may advantageously be used for scraping a wide variety of surfaces while permitting a smooth and consistent push-pull action to be employed by the operator with reduced wrist fatigue.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiment of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A hand-held scraper apparatus for scraping a surface at a plurality of scraping angles, the apparatus including a blade support that has a longitudinal axis and a latitudinal axis, the apparatus to be used by an operator for scraping a surface with a scraping motion parallel to the longitudinal axis of the blade support, the apparatus, comprising:

a rigid handle;

a rigid blade support connected to said handle;

first, second, and third blade-receiving slots located in said blade support and arranged at predetermined increments along a line parallel to the blade support longitudinal axis, each of said first, second and third blade-receiving slots being oriented at a different respective predetermined slant angle between zero and ninety degrees with respect to the blade support longitudinal axis; and a blade for insertion into a respective blade-receiving slot, whereby said blade forms a respective scraping angle with a surface to be scraped that is supplementary to said respective predetermined slant angle that said respective blade-receiving slot forms with respect to the blade support longitudinal axis.

wherein said handle has a longitudinal axis which is parallel to the blade support longitudinal axis, wherein said handle and said blade support are a one-piece structure having a first continuous blade receiving surface extending parallel to said longitudinal axis and a second continuous blade receiving surface orthogonally oriented to said first surface and said longitudinal axis, said first, second, and third blade receiving slots being disposed in said first surface, said apparatus further comprising a fourth blade receiving slot, said fourth blade receiving slot being disposed in said second continuous surface, said second continuous surface being located at the extremity of said one-piece handle and blade support opposite to said handle with respect to said longitudinal axis.

2. The apparatus described in claim 1 wherein said first, second, and third blade-receiving slots are oriented at respective slant angles within a range of less than ninety, but more than zero degrees with respect to the blade support longitudinal axis, and wherein said fourth blade-receiving slot is oriented at angle of zero degrees with respect to said longitudinal axis.

3. The apparatus described in claim 1 wherein said respective blade-receiving slots each include means for gripping a blade; and said blade includes complementary means for engaging said blade gripping means for retaining said blade is said blade-receiving slot.

* * * * *